United States Patent [19]

Wittrisch

[11] Patent Number: 5,054,557

[45] Date of Patent: Oct. 8, 1991

[54] DEVICE FOR EXTRACTING A LIQUID OUT OF A TUBE OF GREAT LENGTH

[75] Inventor: Christian Wittrisch, Rueil-Malmaison, France

[73] Assignee: Institut Francais du Petrole, Rueil Malmaison, France

[21] Appl. No.: 533,751

[22] Filed: Jun. 7, 1990

[30] Foreign Application Priority Data

Jun. 7, 1989 [FR] France ..... 89 07632

[51] Int. Cl.[5] ..... E21B 43/00

[52] U.S. Cl. ..... 166/309; 166/63; 166/311; 166/369

[58] Field of Search ..... 166/369, 309, 311, 63, 166/106

[56] References Cited

U.S. PATENT DOCUMENTS

| | | | |
|---|---|---|---|
| 1,583,756 | 5/1926 | Shea . | |
| 2,740,478 | 4/1986 | Greene . | |
| 2,749,990 | 6/1956 | Carpenter | 166/309 X |
| 2,804,150 | 8/1957 | Fuson . | |
| 2,912,931 | 11/1959 | Carpenter . | |
| 3,059,695 | 10/1962 | Barry . | |
| 3,134,441 | 5/1964 | Barry . | |
| 3,164,206 | 1/1965 | Sharp | 166/309 X |
| 3,265,133 | 8/1966 | Burch . | |
| 3,822,750 | 7/1974 | Ping | 166/309 |
| 3,937,278 | 2/1976 | Sheshtawy . | |

FOREIGN PATENT DOCUMENTS

| | | |
|---|---|---|
| 782225 | 9/1957 | United Kingdom . |
| 2200934 | 8/1988 | United Kingdom . |

*Primary Examiner*—William P. Neuder

*Attorney, Agent, or Firm*—Antonelli, Terry, Stout & Kraus

[57] ABSTRACT

Device for extracting a liquid out of a tube of great length closed at one of its ends in case a communication between the closed end and a source of a substitution fluid should be difficult to establish, the device includes a mobile member provided with a body connected to a supporting surface apparatus, a piston whose cross-section is adapted to the inner cross-section of the tube controlled valve means allowing for the running of the mobile member along the tube and means in the body for providing a substitution fluid such as liquified gas bottles or substances which provide a great volume of gas when combusted. Such a device is useful for example for emptying tube when production tests are conducted in oil wells,.

11 Claims, 2 Drawing Sheets

DEVICE FOR EXTRACTING A LIQUID OUT OF A TUBE OF GREAT LENGTH

BACKGROUND OF THE INVENTION

The invention relates to a method and a device for extracting a liquid out of a tube of great length, closed at one of its ends, in all the cases where a communication between this closed end and a source of a substitution fluid cannot be easily established.

Such a device can for example be applied for evacuating liquids out of tubes taken down in deep wells. It is particularly interesting in the petroleum field where tubings are used for numerous applications, be it for supporting drill bits, outfitting wells for production, or guiding measuring tools taken down for tests during the drilling process or during the production stage.

In order to test a well during the drilling stage, it is well-known to take down to the level of the layers to be tested a sampler comprising a tubing closed at its base by a controlled opening valve and equipped on its circumference with a deformable closing device of the packer type. This device is adapted, in the expansion position, for closely leaning against the wall of the drill hole or the casing when such casing exists and thus for keeping the tubing in position. A pressure-measuring element is placed at the tubing base. The pressure within the tubing, at its base, when the valve is closed, equals the atmospheric pressure if the tube does not contain any water. It can be increased at will by filling part of the tubing with water in order to limit the pressure difference on either side of the valve to a determined value.

On account of the depression at the basis of the tubing in relation to the pressure in the well, a suction occurs at the valve opening and the pressure in the well undergoes a very substantial decrease which is at least partly compensated by the tested formations after a given delay which characterizes the rock permeability. Several successive valve opening and closing cycles are achieved. An analysis of the evolution in terms of time of the measured pressure and flow rate allows to characterize a geologic formation, as it is well-known by the man skilled in the art. Once the test has been carried out, the pressures on either side of the packer must be balanced before taking up the sampler, emptying the tubing and taking the set down again if new tests must be achieved at another depth. When several successive tests are necessary in the same well, the time between the actual measurings is very long because of the numerous necessary operations.

The principle of the evacuation of a tube by extracting its content by means of a mobile plunger displaced in the tube is well-known. It cannot be performed easily without connecting the base of the tube with a source of a substitution fluid such as a gas for example, and introducing it behind the piston as the evacuation is carried out. In all the cases where the base of the tube is little accessible and notably in the application described above, where the tubing is very long and taken down in a narrow well, setting up any piping allowing a connection with a gas source often proves to be difficult, if not unworkable in practice.

SUMMARY OF THE INVENTION

The device according to the invention allows to evacuate at least part of the fluids contained in a tube of great length, closed at one of its ends and open at its opposite end, and especially of a tubing equipped with retractable means for immobilizing in a well, and this without having to establish a connection between the base of the tube and a source of a substitution fluid, thus avoiding the drawbacks mentioned above. It comprises a mobile element the displacement of which towards the open end of the tube ejects the liquid outwards and motor means for displacing the mobile element in the tube. It is characterized by an electric carrying cable in order to continuously connect the mobile element with a surface installation, closing means which can be operated by remote control through said electric carrying cable, in order to separate the parts of the well on either side of the mobile element, means for measuring the pressure in the well on either side of the mobile element, means for generating a substitution gas on the mobile element and a lifting device connected with the cable and adapted for displacing the mobile element towards the open end at a velocity suited to the gas flow released by the gas generating means.

According to an advantageous embodiment, the means for generating the substitution gas comprise a volume of a substance generating gas by combustion.

The means for generating the gas comprise for example a cartridge containing a pyrotechnic substance and control means for releasing its igniting through the electric carrying cable.

According to one embodiment, the mobile element comprises an extended body passing across said piston equipped with a first end connected with the lifting device and with a second end open below said piston, the body comprising a chamber for the combustible substance.

The mobile element for example comprises at least one set of cups placed so as to closely lean against said tube and form a piston when it is displaced towards the open end, and each set of cups comprises for example multiple deformable lips.

Each set of cups can also be adapted for forming a piston for tubing portions of different sections.

According to one embodiment, the mobile element comprises several sets of cups stepped along the body with a sufficient distance between each other so that at least one set is always in contact with the wall of the tube, whatever the section inequalities of the latter may be.

Said retractable means can comprise for example a packer with an inflatable hall and the means for generating a substitution fluid which may comprise liquefied gas bottles.

The method according evacuation the invention allows to of the fluids out of a tube of great length closed at one first end and open at its opposite end, such as a equipped with means for immobilizing the tube in a well.

It comprises taking down in the tube, towards its closed end, a mobile element connected with lifting means placed on the side of the open end of the tube, said mobile element having means for forming a piston when it is displaced towards the open end of the tube, and it is characterized by the forming of a volume of gas between the mobile element and the closed end of the tube and a traction being exerted on the cable at a velocity proportionate to the generated flow of gas so that the pressure difference on either side of the mobile element remains within determined limits.

The device according to the invention facilitates the operations for extracting a fluid out of a tubing closed at its base on account of the surface operators being permanently connected with the mobile element through the electric carrying cable and on account of their being able to:

operate the closing means in the mobile element at will by remote control and adjust the pulling velocity according to the generated gas flow by basing on the pressure difference which is permanently measured on either side of the mobile element and transmitted to the surface.

BRIEF DESCRIPTION OF THE DRAWINGS

Other features and advantages of the method and the device according to the invention will be clear from reading the description hereafter with reference to the accompanying drawings in which.

DESCRIPTION OF THE PREFERRED EMBODIMENTS

Figure 1:
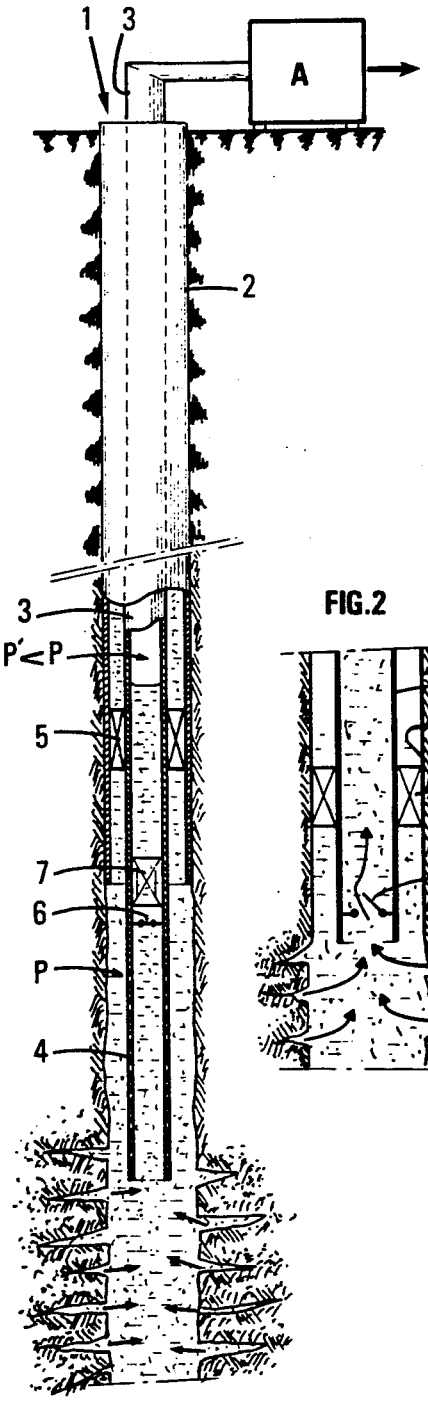
FIG. 1 shows a flowsheet of a tubing system of a well-known type allowing to test a subterranean formation, where the evacuation device according to the invention can be advantageously used.

The study of the subterranean areas producing or likely to produce hydrocarbons notably focuses on the permeability of the formations which a well runs across. A well-known method for measuring this parameter consists in taking down into a well 1, bare or equipped with a casing 2 (FIG. 1), a tubing 3 generally consisting of multiple tubular sections, of a length sufficient for reaching the subterranean are to be studied. Its lower end is fitted with lateral holes or perforations 4. Tubing 3 is associated with a packer 5 of a well-known type fastened at its circumference, which comprises for example a deformable hall that can be inflated until it closely presses against the wall of well 1 or of its casing 2. The inflating of packer 5 thus isolate the lower part of the well at the level of the area to be tested. A valve 6 of a known type, the opening and the closing of which can be controlled at will from the surface by rotating tubing 3 or by exerting a traction on it, is placed within tubing 3. A measuring set 7 comprising a flowmeter as well as pressure and temperature pick-ups is also placed within tubing 3. The latter can be connected at its upper end to a device A for measuring the flow rate and the pressure.

Figure 2:
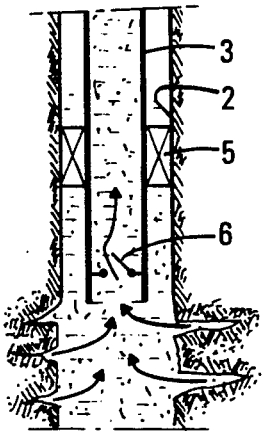
FIG. 2 shows a part of the previous drawing where the tubing is open at its base in order to suck the fluids of the subterranean formation.
Figure 5:
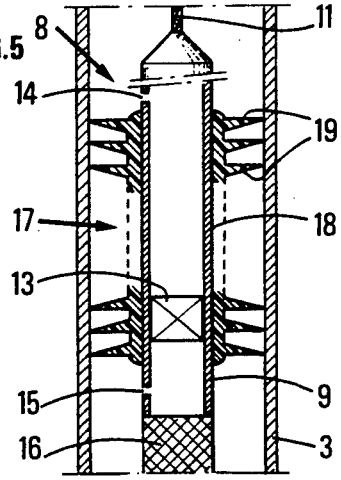
FIG. 5 shows a mobile element with cups acting as a piston in order to take up the fluid out of the tubing.
Figure 6:
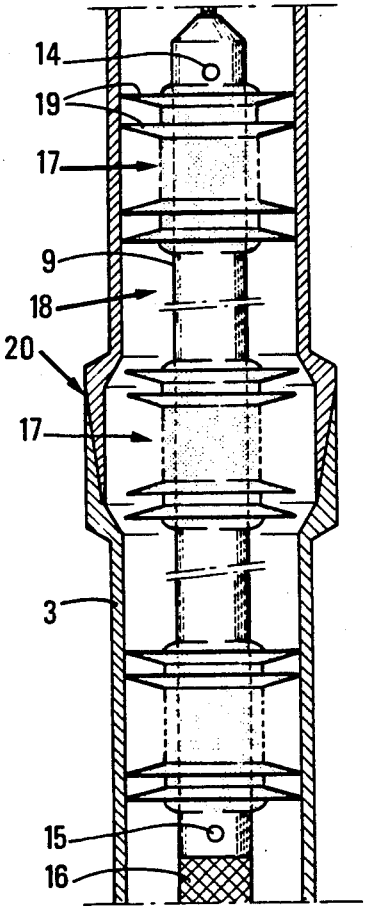
FIG. 6 shows a mobile element comprising several cup stages in order to better adapt to possible changes in the tubing section.

Valve 6 being closed and packer 5 being in a release position, tubing 3 is taken down into the well to the chosen depth. Packer 5 is then inflated in order to immobilize tubing 3 by isolating the lower part of the well. A series of successive openings and closings of valve 6 is then performed (FIG. 2) in order to study the response of the subterranean formation to the suction caused by the connecting of the well with the inside of the tubing where the pressure is lower.

At the end of the testing sequence, the tubing is filled with a fluid at least part of which comes from the well. The device according to the invention, such as it is shown in FIG. 3 to 7, restores the initial depression in the tube without having to take the tube up in order to empty it of its content.

The device according to the invention comprises a mobile element 8 which can be taken down i.e. directed downwardly into tubing 3 across or through the mass of fluid to be evacuated. Element 8 comprises a cylindrical body 9 of a section smaller than that of tubing 3. A piston 10 having a cross-section adapted to conform to the inner cross-section of the tubing is fastened at the circumference of body 9. The body is connected through a cable 11 to a lifting device 12 such as a winch which is placed at the surface. A check valve 13, which is preferably electromagnetically controlled and which can be actuated from the surface by a control line enclosed in cable 11, is placed within body 9. Openings 14, 15 are provided in the wall of body 9, on either side of piston 10. The descent of the mobile element in the tubing is possible through the controlled opening of check valve 13 which opens a by-pass channel through openings 14, 15 to the fluid contained in tubing 3. Pressure pick-ups C1, C2 are placed in body 9, preferably on either side of check valve 13, and connected through cable 11 to the surface installation. It is thereby possible to know at any time the depth of immersion of the mobile element in the tubing and the pressure which prevails in the space between the mobile element and the closed end of the tubing.

Figure 4:
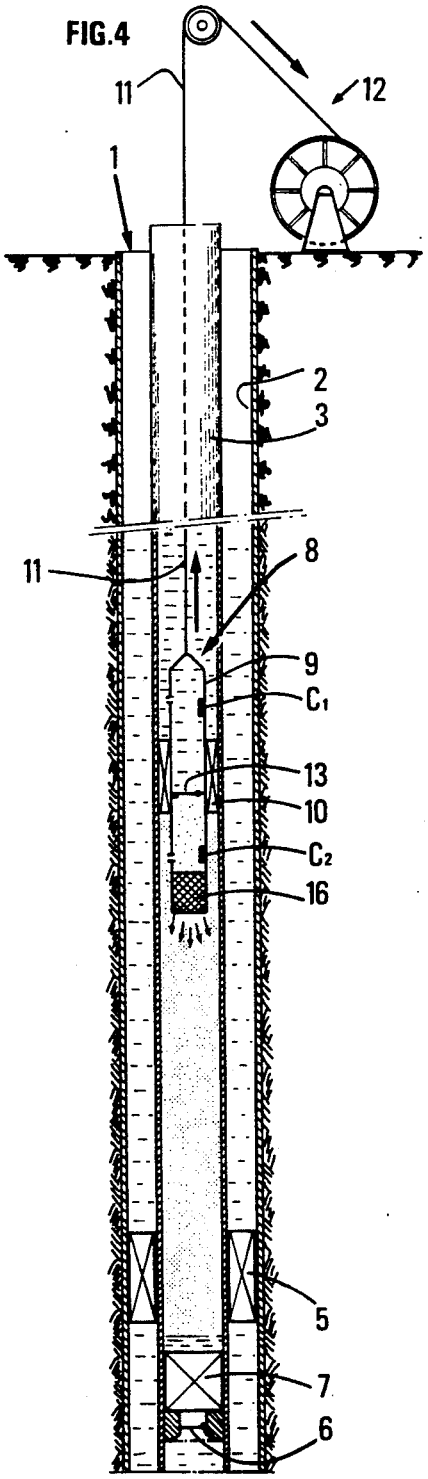
FIG. 4 shows a similar view of the device in the extraction stage when a substitution fluid is generated.

The evacuation of the fluid above the mobile element is obtained through a pumping effect, by closing check valve 13 and pulling on cable 11 by means of lifting device 12. This is only possible in practice if a substitution fluid is introduced under piston 10 (FIG. 4).

To that effect, the body 9 comprises, at its base, a chamber where means 16 are placed for providing this substitution fluid. In the practical conditions of use of the device, the volume of fluid to be provided is often considerable. If one takes into account for example the case where a tubing with an inner diameter of 7 cm must be emptied, it is necessary to produce enough fluid in order to fill the few 3.8 $m^3$ which are left free by a 1,000 m-retraction of the mobile piston. This substitution fluid can for example be provided by one or several liquefied gas bottles.

According to a preferred embodiment, the substitution fluid is a gas produced by the combustion of an appropriate substance contained in one or several cartridges. Substances which are generally used in pyrotechnic systems or in certain packers (manufactured for example by the Baker Oil Tools Company) can be utilized in order to cause a hydraulic pressure. This solution is advantageous because cartridges with a low weight and volume allow to obtain the considerable volume of gas that is required.

The evacuation of the fluid out of the tubing can be performed in one or several stages according to the volume to be carried off.

Figure 3:
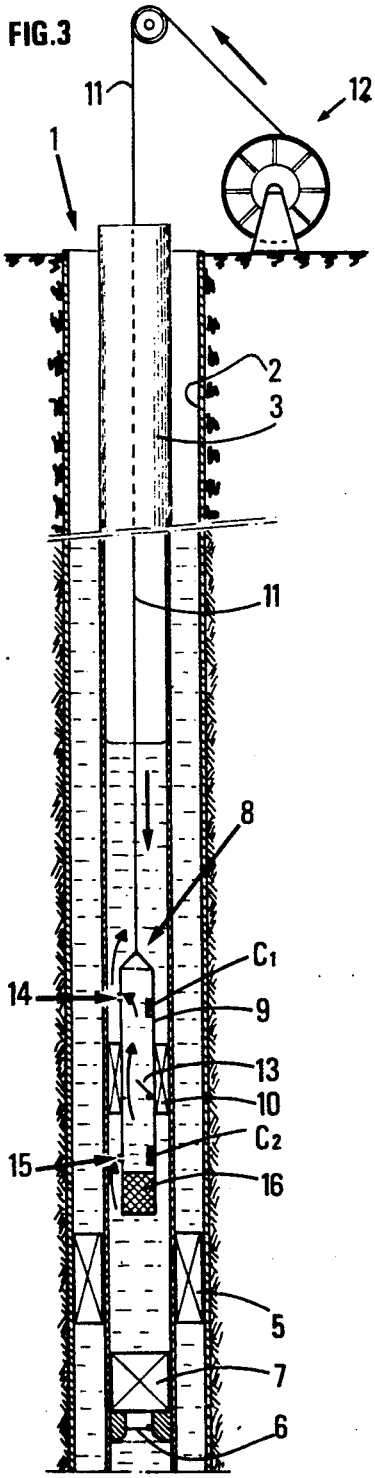
FIG. 3 shows a diagram of the device according to the invention taken down in the tubing in order to extract the fluid it contains at the end of each test.

The mobile element 8 is taken down i.e. directed downwardly into the tubing after opening of check valve 13 (FIG. 3). When it has reached the chosen depth, check valve 13 is closed and the element is towed towards the surface. Means 16 are activated in order to generate the substitution fluid (FIG. 4). The indications given by pick-up C2 allow to adjust the pulling velocity of the mobile element to the gas flow generated by means 16, so that the difference of pressure on either side remains within allowable limits.

If the height of fluid to be evacuated is too considerable in view of the practical operating conditions, the mobile element is only taken down in the fluid at a limited height according to the indications provided by pressure pick-up C1 integrated in the body of mobile element 8. Several stages are also carried out if the inner wall of the tubing shows enough irregularities for substantial leaks to occur at the circumference of piston 10. In order to avoid having to set up again new means 16 for generating gas (gas bottles or pyrotechnic cartridges) every time the mobile element goes up, it is preferable to install several of them which can be controlled separately.

The use of a remote control check valve 13 allows, in case of an anomaly, to rebalance the pressures in the tubing on either side of the piston.

According to a preferred embodiment, the piston placed or positioned around body 9 consists of at least one set of sealing cups 17 comprising for example a sleeve 18 placed around body 9 and fitted with cups or lips 19 made of a deformable material such as an elastomer, the section of these cups being substantially equal to that of the tubing.

A tubing of great length generally consists of multiple sections connected to one another by screwing together. The section of the tubing in the connection zones is increased. The embodiment illustrated by FIG. 6 keeps the tightness around the mobile element in spite of the inequalities of section of tubing 3. It comprises several sets of cups 17 stepped along body 9 so that at least one of them closely presses against the tubing when the mobile element reaches the level of a connection area 20 between the sections.

I claim:

1. A device for evacuating fluids out of a tube of great length closed at one first end and open at an opposite end, said tube being equipped with retractable means for immobilizing the tube in a well; said device comprising a mobile element the displacement of which towards the open end of the tube ejects the fluids outwardly and motor means for displacing the mobile element, an electric carrying cable for permanently connecting the mobile element with a surface installation, closing means which can be remotely controlled through said electric carrying cable in order to separate portions of the well on either side of the mobile element, means for measuring the pressure prevailing in the well on either side of the mobile element, means for generating a substitution gas on the mobile element and a lifting device connected to the cable for displacing the mobile element towards the open end at a velocity adapted to the outflow of gas released by the gas generating means.

2. A device as claimed in claim 1, wherein the means for generating the substitution gas comprise a volume of a substance for generating a gas by combustion.

3. A device as claimed in claim 2, wherein the substitution means for generating the gas comprise a cartridge containing a pyrotechnic substance and control means for triggering ignition thereof through the electric carrying cable.

4. A device as claimed in any one of claims 1 to 3, wherein the mobile element comprises an elongated body having a piston of a cross-section adapted to conform to an inner cross-section of the tube, said elongated body passing across said piston and being fitted with a first end connected to the lifting device and with a second end open below said piston, the body further having a chamber for containing a combustible substance comprising the gas generating means.

5. A device as claimed in claim 1, wherein the mobile element further comprises at least one set of cups placed in such a way that the cups closely press against said tube and form a piston when the mobile element is displaced towards the open end.

6. A device as claimed in claim 5, wherein each set of cups comprises multiple deformable lips.

7. A device as claimed in claim 5 wherein each set of cups is adapted for forming a piston for tube portions of different cross-sections.

8. A device as claimed in claim 5, wherein the mobile element comprises several sets of cups stepped along the body with a sufficient distance between one another so that at least one set is always in contact with the wall of the tube, whatever the cross inequalities of the tube may be.

9. A device as claimed in claim 1, wherein said retractable means comprise a packer with an inflatable hall.

10. A device as claimed in claim 1, wherein the means for generating a substitution fluid comprise liquefied gas bottles.

11. A method for evacuating fluids out of a tube of great length closed at one first end and open at an opposite end, said tube being equipped with means for immobilizing the tube within a well, said method comprising directing the mobile unit downwardly into the tube towards the closed end, said mobile element being connected to a lifting means placed on a side of the open end of the tube by a cable, and said mobile element having means for forming a piston as the element is displaced towards the open end of the tube; forming a volume of gas between the mobile element and the closed end of the tube; and exerting a traction on the cable at a velocity proportionate to a flow of the formed gas, so that the difference of pressure on either side of the mobile element remains within determined limits.

* * * * *